US006991832B2

(12) United States Patent
Lefebvre et al.

(10) Patent No.: US 6,991,832 B2
(45) Date of Patent: Jan. 31, 2006

(54) METHOD OF PRODUCING A FUSIBLE INTERFACING WITH DOTS OF HOT-MELT POLYMER, AND HOT-MELT POLYMER DESIGNED ESPECIALLY FOR CARRYING OUT SAID METHOD

(75) Inventors: Jean Lefebvre, Estrees Mons (FR); Benoît Mesnil, Biache Saint Vaast (FR)

(73) Assignee: Lainiere de Picardie BC, Peronne (FR)

( * ) Notice: Subject to any disclaimer, the term of this patent is extended or adjusted under 35 U.S.C. 154(b) by 112 days.

(21) Appl. No.: 10/302,486

(22) Filed: Nov. 22, 2002

(65) Prior Publication Data

US 2003/0099781 A1 May 29, 2003

(30) Foreign Application Priority Data

Nov. 26, 2001 (FR) ..... 01 15272

(51) Int. Cl.

| | |
|---|---|
| ***B05D 3/06*** | (2006.01) |
| ***B05D 1/26*** | (2006.01) |
| ***B05D 5/10*** | (2006.01) |
| ***C08J 7/18*** | (2006.01) |

(52) U.S. Cl. ..... 427/504; 427/505; 427/507; 427/208.2; 427/208.6

(58) Field of Classification Search ..... 427/504, 427/505, 506, 507, 208.2, 208.6, 551, 552
See application file for complete search history.

(56) References Cited

U.S. PATENT DOCUMENTS

| | | | | |
|---|---|---|---|---|
| 4,234,662 | A * | 11/1980 | Pastor et al. | 428/500 |
| 4,748,044 | A * | 5/1988 | Fottinger et al. | 427/501 |
| 4,874,655 | A * | 10/1989 | Groshens | 428/198 |
| 4,908,229 | A | 3/1990 | Kissel | |
| 5,993,918 | A * | 11/1999 | Groshens et al. | 427/552 |
| 6,824,728 | B2 * | 11/2004 | Husemann et al. | 264/446 |
| 6,858,110 | B1 * | 2/2005 | Himmelsbach et al. | 156/291 |
| 6,858,695 | B2 * | 2/2005 | Schmidt et al. | 526/329.2 |
| 2002/0182350 | A1 * | 12/2002 | Schmidt et al. | 428/35.7 |

FOREIGN PATENT DOCUMENTS

| | | | |
|---|---|---|---|
| EP | 0 775 773 A | | 5/1997 |
| EP | 0 855 146 A | | 7/1998 |
| JP | 62-57986 | * | 3/1987 |
| JP | 2003-193319 A | * | 7/2003 |

OTHER PUBLICATIONS

Patent Abstracts of Japan, vol. 1995, No. 04, May 13, 1995—& JP 07 011585 A (Kotec KK), Jan. 13, 1995, to Kakishita Tomonari.

* cited by examiner

*Primary Examiner*—Marianne Padgett
(74) *Attorney, Agent, or Firm*—Weingarten, Schurgin, Gagnebin & Lebovici LLP

(57) ABSTRACT

In order to produce a fusible interfacing, dots of a hot-melt polymer are deposited on the right side of an interfacing support selected from textile and nonwoven supports and the wrong side of the interfacing support undergoes electron bombardment. The dots of hot-melt polymer are based on at least one functionalized polymer comprising functional groups that can react with free radicals generated by the action of an electron bombardment and/or which are themselves generators of free radicals under the action of an electron bombardment. The penetration depth of the electrons into the polymer dots is adjusted to obtain self-crosslinking of said functionalized polymer over a limited thickness e with respect to the mean thickness E of the polymer dots. The functional groups preferably comprise functions containing an ethylenically unsaturated bond, for example of the acrylate, methacrylate, allyl, acrylamide, vinylether, styrene, maleic or fumaric type.

4 Claims, No Drawings

METHOD OF PRODUCING A FUSIBLE INTERFACING WITH DOTS OF HOT-MELT POLYMER, AND HOT-MELT POLYMER DESIGNED ESPECIALLY FOR CARRYING OUT SAID METHOD

The present invention relates to the field of fusible interfacing, namely textile or nonwoven supports on one face of which dots of hot-melt polymer have been applied, which can then adhere to a piece of apparel to reinforce it once a certain amount of hot pressure has been applied. More particularly, the invention relates to a method of producing said interfacing using an electron bombardment technique to locally modify the melting point and/or viscosity of the hot-melt polymer; the invention also relates to a hot-melt polymer designed especially for carrying out said method.

BACKGROUND OF THE INVENTION

One of the most difficult problems to overcome in the field of fusible interfacing is the risk of penetrating the interfacing support when hot pressing the fusible interfacing against the piece of apparel to be reinforced. The temperature selected to carry out that hot pressing must melt the polymer dot so that the molten polymer can spread and adhere to the fibers or filaments on the surface of the piece of apparel. However, spreading does not always occur just on the surface, and the molten polymer flows through the fibers or filaments and appears on the opposite face of the interfacing support. This does not cause a problem as regards appearance unless the interfacing is intended to be visible and to form the right side of the garment. In all cases, that penetration locally increases the stiffness of the interfacing and thus of the piece of apparel, which can be contrary to the desired effect. It can also adhere to backing fabric such as linings and cloth facings, which has a deleterious effect on the quality of the garment.

To overcome this difficulty, a fusible interfacing wherein the dots of hot-melt polymer comprise two superimposed layers has already been proposed; a first layer is in contact with the right side of the interfacing support and a second layer is disposed in precise alignment over the first. Clearly, the constituents of the two layers are determined so that during application with heat pressure to the piece of apparel, only the hot-melt polymer of the second layer reacts under the action of heat. In that case, the hot-melt polymer can only spread towards the piece of apparel, and is prevented from spreading towards the interfacing support as the first layer acts as a kind of barrier.

In practice, that technique of two superimposed layers has disadvantages, in particular problems with superimposing the two layers and a risk of delaminating the two layers.

To overcome the above disadvantages, the Applicant has already proposed, in French patent FR-A-2 606 603, the use of means of a chemical nature acting on the hot-melt polymer to modify its chemical structure at least partially at least at the interface with the interfacing support, to prevent the hot-melt polymer from adhering through the interfacing support under the effect of heat and/or pressure and/or steam. The means of a chemical nature that can modify the chemical structure of the hot-melt polymer comprise at least one reactive substance and at least one reactive means that can initiate, ensure, and encourage the reaction between the reactive substance and the hot-melt polymer.

Contact between the reactive substance and the hot-melt polymer is made either by mixing those two elements, which are then deposited as an intimate mixture, in the form of dots, on the interfacing support, or by applying the reactive substance to the interfacing support before depositing dots of polymer (which are then free of reactive substance). Heat sources, ultraviolet radiation and electron bombardment are cited amount the reactive means.

The Applicant has also proposed, in European patent EP-A1-0 855 146, a method in which dots of hot-melt polymers with a mean thickness E and containing a radical activator are deposited on the right side of an interfacing support and one of the faces of the support undergoes electron bombardment, adjusting the penetration depth of the electrons into the dots of hot-melt polymer to produce a modification in the physico-chemical properties of the hot-melt polymer selected from the melting point and the viscosity over a thickness $\underline{e}$ with respect to the mean thickness E.

The radical activator creates free radicals that can initiate self-polymerization of the hot-melt polymer. Thus, it does not strictly concern a reactive substance as envisaged in FR-A-2 606 603.

The techniques taught by the two documents cited above have a variety of disadvantages. In FR-A-2 606 603, when the reactive substance is applied to the interfacing support before depositing the polymer dots, the reaction that occurs after providing heat, UV irradiation or electron bombardment occurs at the interface between the reactive substance and the hot-melt polymer. This reaction thus only occurs over a much reduced thickness. In all the other cases the reactive substance of FR-A-2 606 603 or the radical agent of EP-A1-0 855 146 is mixed with the hot-melt polymer prior to depositing dots on the interfacing support. That mixture is normally produced when the polymer is dispersed in the form of a paste, the reactive substance or radical agent then being incorporated like any other product of the formulation. To obtain a more intimate mixture, according to EP-A1-0 855 146, the hot-melt polymer and radical activator are first mixed, then the mixture undergoes the successive operations of fusion, extrusion and grinding to obtain a powder that is used as it is for coating or diluted for subsequent preparation of an aqueous dispersion in the form of a paste to deposit dots of polymer on the interfacing support. However, regardless of the intimate nature of the mixture, each dot applied to said interfacing support has a heat fusible polymer that provides the adhesive function which is required to adhere the interfacing support to the piece of apparel to be reinforced, and a reactive substance or a radical agent which provides the reactivity function under the action of reactive means such as a heat source, UV irradiation or electron bombardment, this latter being of particular relevance to a radical agent.

In the particular case of a method of producing a fusible interfacing using electron bombardment to modify the chemical structure of the hot-melt polymer, the presence of a radical agent causes a certain number of difficulties. When the technique for depositing polymer dots employs an aqueous dispersion in the form of a paste, the components of the paste formulation have to be soluble in water for the paste to be stable over time. However, most products that are suitable radical agents are insoluble in water, at least in the proportions in which they are used to prepare the aqueous dispersion, which can cause relative instability of the paste over time. Further, products that are suitable as radical agents are generally in the form of a liquid, with boiling points that may be incompatible with the temperatures used under the operating conditions employed when depositing dots on the interfacing support. In that case, some of the radical agent may evaporate, which causes a loss in or even disappearance of the reactivity to electron bombardment. Finally, it has also been observed that, because products that are suitable as radical agents are generally low molecular weight monomers, their behavior in a mixture with a hot-melt polymer is compatible with that of a plasticizer. That behavior can involve a change in the melt viscosity of the hot-melt polymer, it can cause problems as regards the quality or with coating, and it can also change the intrinsic mechanical strength of the polymer and thus influence adhesion performance.

OBJECTS AND SUMMARY OF THE INVENTION

The Applicant aims to provide a method of producing a fusible interfacing employing electron bombardment to modify the chemical structure of the hot-melt polymer which overcomes the disadvantages cited above.

This aim is achieved by the method of the invention in which, as is known, dots of a hot-melt polymer are deposited on the right side of an interfacing support selected from textile and nonwoven supports and the right face of the interfacing support undergoes electron bombardment. In the invention, the dots of hot-melt polymer are based on at least one functionalized polymer comprising functional groups that can react with free radicals generated by the action of the electron bombardment and/or which are themselves generators of free radicals under the action of the electron bombardment; further, the penetration depth of the electrons into the polymer dots is adjusted to obtain, due to said functional groups, self-crosslinking of said functionalized polymer over a limited thickness e with respect to the mean thickness E of the polymer dots.

All of the disadvantages cited above connected with a mixture of hot-melt polymer and the radical agent are eliminated since the hot-melt polymer itself comprises both the adhesion function and the function of reactivity to electron bombardment.

In a further aspect, the invention provides a hot-melt polymer for a fusible interfacing, designed especially for carrying out said method. This hot-melt polymer comprises functional groups that can react with free radicals under the action of electron bombardment and/or which can themselves generate free radicals under the action of electron bombardment.

In a first version, said functional groups comprise functions containing an ethylenically unsaturated bond, for example of the acrylate, methacrylate, allyl, acrylamide, vinylether, styrene, maleic or fumaric type.

In a second version, said functional groups comprise labile entities, i.e., entities with bonding energies that are lower than the usual carbon-carbon or carbon-hydrogen bonds. An example of a labile entity that can be cited is a carbon-chlorine bond, C—Cl, or a thiol bond, S—H.

DETAILED DESCRIPTION OF THE INVENTION

The functionalized hot-melt polymers of the invention are obtained in two possible ways. Firstly, monomers carrying the functional group or groups that can react with free radicals under the action of electron bombardment and/or which are themselves generators of free radicals under the action of electron bombardment are added directly to the reaction medium for synthesizing the polymer. Secondly, the already constituted hot-melt polymer is subsequently transformed by grafting the desired functional groups onto the polymer structure using known grafting techniques.

Placing the functional group along the polymer chain considerably influences the reactivity of the functionalized polymer under the action of electron bombardment as well as the structure of the crosslinked network obtained. The functional group can be located at the end of a chain, included in the chain, or it can be located on branches or grafts along the main polymer chain.

The functionalized hot-melt polymer of the invention must necessarily possess the adhesive properties required for the envisaged use, namely fusible interfacing. Further, it must be capable of being functionalized either during synthesis or by subsequent transformation, as indicated above. More particularly, then, it is of the polyethylene (PE), copolyamide (coPA), polyester (Pes), polyurethane (PU) or copolyamide block ether (PBAX) type. Non-limiting examples for a polyamide type backbone are functional groups that are located at the chain end; for a polyethylene type backbone, the functional groups are located on branches along the main chain; with a polyester type backbone, the functional groups are included along the main chain; with a polyurethane type backbone, the functional groups are grafted along the main chain.

Clearly, the functionalized hot-melt polymer of the invention is selected to satisfy the conditions of use of a fusible interfacing, which conditions vary as a function of the techniques employed.

In particular regarding presentation, this polymer should have been supplied in the form of a powder that is resistant to grinding for grain sizes of 10 micrometers ($\mu$m) to 200 $\mu$m or that can be supplied as granules if the technique used is the hot-melt type.

When the polymer dots are deposited as an aqueous dispersion in the form of a paste, the polymer must clearly be compatible with forming such an aqueous dispersion.

When deposition is carried out by coating, the functional groups in the hot-melt polymer must be stable to the coating temperature knowing that depending on the technique used, this temperature can be from 150° C. to 225° C. This thermal stability is indispensable to prevent the functional groups from giving rise to uncontrolled initiation of self-crosslinking. This thermal stability can be improved by incorporating an antioxidant into the functionalized hot-melt polymer.

The melting point of the functionalized hot-melt polymer of the invention, which does not undergo electron bombardment, must generally be in the range 70° C. to 150° C., knowing that the melting point of the same polymer self-crosslinked under the action of the electron bombardment is higher.

Depending on its applications, the functionalized hot-melt polymer of the invention is resistant to machine washing, resistant to dry cleaning with a chlorinated solvent and is also steam resistant.

In one embodiment, the functionalized polymer has a polyethylene backbone and comprises functional methacrylate type groups. To obtain this functionalized polymer, we start with an initial polymer obtained from ethylene monomers and a small percentage, of the order of 3% by weight, of acrylic acid. This initial polyethylene type polymer comprises acidic functions (—COOH) attached to the carbon chain. In particular, it is an EAA polymer sold by DOW CHEMICAL under the trade name Primacor 3150. This initial polymer undergoes an esterification reaction with an epoxy type compound with formula:

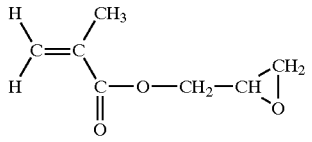

sold by Aldrich under the trade name GMA, in stoichiometric proportions. The functionalized polymer with the following formula is obtained:

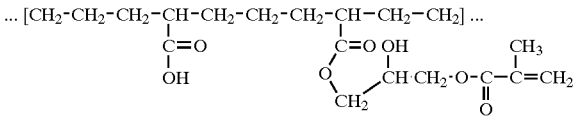

the functional methacrylate groups of which comprise unsaturated ethylenic bonds that can carry out self-crosslinking of the polymer to itself by means of free radicals generated by the action of electrons during electron bombardment. This electron bombardment is carried out at a power of at least 70 kilovolts (kV), with a dose of the order of 10 kilograys (kGy) to 100 kGy on the wrong side of the interfacing support the right side of which comprises dots formed with the functionalized polymer. The power and dose limit the action of the electrons to a limited thickness e of the mean thickness of the deposited dots. Self-crosslinking the functionalized polymer only occurs over this thickness *e* of the dot from the base of said dot, i.e., that portion which is in contact with the interfacing support. The self-crosslinked polymer has a melting point that is higher than that of the functionalized non-self-crosslinking polymer such that during application of the interfacing to the article to be reinforced, the self-cross-linked base of the polymer dot flows less than the remainder of the dot, avoiding penetration.

A second and third example of functionalized polymers with a polyethylene type backbone can be cited.

In the second example, the functional groups are of the styrene type. The initial polymer is obtained from an ethylene monomer and of the order of 10% by weight of hydroxyethyl methacrylate. It may be an EHEMA polymer provided by Neste Chemical under the trade name NRT 354. It reacts with a meta-isopropenyl compound with formula:

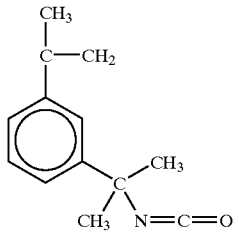

sold by American Cyanamid under the trade name TMI to produce the functionalized polymer with general formula:

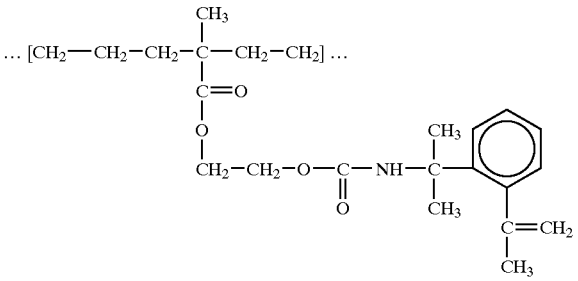

In the third example, the functional groups are of the acrylate type. The initial polymer is obtained from an ethylene monomer and of the order of 16% by weight of vinyl alcohol. It may be an EVOH polymer sold by Bayer under the trade name Levasint S-31. It reacts with an acrylic acid compound to produce the functionalized polymer with general formula:

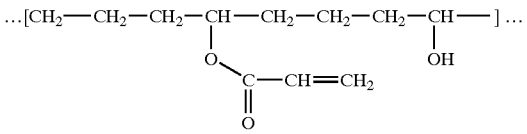

In all cases, the operating conditions for the different reactions carried out are determined so that a functionalized polymer is obtained that contains a suitable proportion of functional groups to obtain the desired result, i.e., to obtain, under the action of electrons, a localized increase in the melting point due to self-crosslinking of said functionalized polymer and which also satisfies the conditions imposed by application of the fusible interfacing to the support on which the dots of functionalized polymer are deposited.

What is claimed is:

1. A method of producing a fusible interfacing, in which dots of a hot-melt polymer, having a mean thickness E, are deposited on the right side of an interfacing support selected from textile and nonwoven supports and the wrong side of the interfacing support undergoes electron bombardment, wherein the dots of hot-melt polymer are based on at least one functionalized polymer comprising functional groups that can react with free radicals generated by the action of an electron bombardment and functional groups which are themselves generators of free radicals under the action of an electron bombardment, and wherein the penetration depth of the electrons into the polymer dots is adjusted to obtain selt-crosslinking of said functionalized polymer over a thickness e less than the mean thickness E.

2. The method of claim 1, wherein the functional groups comprise acrylate, methacrylate, allyl, acrylamide, vinylether, styrene, maleic or fumaric groups.

3. The method of claim 1, wherein the functional groups comprise labile entities with bonding energies that are lower than carbon-carbon or carbon-hydrogen bonding energies.

4. The method of claim 3, wherein the labile entity is a carbon-chlorine bond or a thiol bond.

* * * * *

UNITED STATES PATENT AND TRADEMARK OFFICE

CERTIFICATE OF CORRECTION

PATENT NO. : 6,991,832 B2
APPLICATION NO. : 10/302486
DATED : January 31, 2006
INVENTOR(S) : Jean Lefebvre et al.

It is certified that error appears in the above-identified patent and that said Letters Patent is hereby corrected as shown below:

In column 6 lines 40-59:
Replace claims 1-3 with the following.

--1. A method of producing a fusible interfacing, in which dots of a hot-melt polymer, having a mean thickness E, are deposited on the right side of an interfacing support selected from textile and nonwoven supports and the wrong side of the interfacing support undergoes electron bombardment, wherein the dots of hot-melt polymer are based on at least one functionalized polymer comprising first functional groups that generate free radicals under the action of an electron bombardment and second functional groups that can react with free radicals, and wherein the penetration depth of the electrons into the polymer dots is adjusted to obtain self-crosslinking of said functionalized polymer over a thickness e less than the mean thickness E, by reaction of the generated free radicals with the second functional groups.

2. The method of claim 1, wherein the second functional groups are selected from the groups consisting of acrylate, methacrylate, allyl, acrylamide, vinylether, styrene, maleic and fumaric groups.

3. The method of claim 1, wherein the second functional groups comprise labile entities with bonding energies that are lower than carbon-carbon or carbon-hydrogen bonding energies.--

Signed and Sealed this

Seventh Day of August, 2007

JON W. DUDAS
*Director of the United States Patent and Trademark Office*